US007611424B2

(12) United States Patent
Nagai et al.

(10) Patent No.: US 7,611,424 B2
(45) Date of Patent: Nov. 3, 2009

(54) GOLF CLUB HEAD AND GOLF CLUB

(75) Inventors: Masao Nagai, Osaka (JP); David Llewellyn, Duluth, GA (US); Tetsuya Kanayama, Amagasaki (JP)

(73) Assignee: Mizuno USA, Inc., Norcross, GA (US)

( * ) Notice: Subject to any disclaimer, the term of this patent is extended or adjusted under 35 U.S.C. 154(b) by 315 days.

(21) Appl. No.: 11/673,802

(22) Filed: Feb. 12, 2007

(65) Prior Publication Data

US 2008/0194354 A1 Aug. 14, 2008

(51) Int. Cl.
*A63B 53/06* (2006.01)

(52) U.S. Cl. ..... 473/334; 473/335; 473/345; 473/349

(58) Field of Classification Search ..... 473/324–350, 473/256, 287–292
See application file for complete search history.

(56) References Cited

U.S. PATENT DOCUMENTS

| | | | | | |
|---|---|---|---|---|---|
| 2,155,830 | A | * | 4/1939 | Howard | 473/246 |
| 2,460,445 | A | | 2/1949 | Bigler | |
| 2,652,256 | A | | 9/1953 | Thomas | |
| 3,995,857 | A | | 12/1976 | Cochran et al. | |
| 4,008,896 | A | | 2/1977 | Gordos | |
| 4,027,881 | A | | 6/1977 | Hufenus | |
| 4,085,934 | A | | 4/1978 | Churchward | |
| D275,412 | S | | 9/1984 | Simmons | |
| 4,530,505 | A | * | 7/1985 | Stuff | 473/250 |
| 4,895,371 | A | * | 1/1990 | Bushner | 473/336 |
| 5,282,625 | A | | 2/1994 | Schmidt et al. | |
| 5,447,309 | A | | 9/1995 | Vincent | |
| 5,769,737 | A | * | 6/1998 | Holladay et al. | 473/336 |
| 5,776,010 | A | | 7/1998 | Helmstetter et al. | |
| 5,785,605 | A | | 7/1998 | Helmstetter | |
| 5,785,609 | A | | 7/1998 | Sheets et al. | |
| 5,967,905 | A | | 10/1999 | Nakahara et al. | |
| 5,971,867 | A | | 10/1999 | Galy | |
| 5,989,134 | A | | 11/1999 | Antonious | |
| 6,015,354 | A | | 1/2000 | Ahn et al. | |
| 6,077,171 | A | | 6/2000 | Yoneyama | |
| 6,126,556 | A | * | 10/2000 | Hsieh | 473/256 |

(Continued)

FOREIGN PATENT DOCUMENTS

| | | |
|---|---|---|
| CA | 2553362 | 2/2007 |

(Continued)

OTHER PUBLICATIONS

European Patent Office Search Report for EP U.S. Appl. No. 08002354.2 filed May 27, 2008.

(Continued)

*Primary Examiner*—Sebastiano Passaniti
(74) *Attorney, Agent, or Firm*—Troutman Sanders LLP; James H. Yancey, Jr.; Michael Brignati

(57) ABSTRACT

A golf club head of the wood-type, including: a body defining an interior cavity and including a ball-striking face, a sole, a crown, and a ribbon extending rearwardly from the face; an elongated groove that extends along a portion of the ribbon; a weight slidably disposed in the elongated grove; and a fastener affixed to the weight capable of selectively fixing a location of the weight.

20 Claims, 4 Drawing Sheets

U.S. PATENT DOCUMENTS 6,177,032 B1 1/2001 Smith et al.
6,206,790 B1 3/2001 Kubica et al.
6,210,290 B1 4/2001 Erickson et al.
6,217,461 B1 4/2001 Galy
6,364,788 B1 4/2002 Helmstetter et al.
6,379,264 B1 * 4/2002 Forzano ..... 473/336
6,409,612 B1 6/2002 Evans et al.
6,440,009 B1 8/2002 Guibaud et al.
6,551,200 B1 4/2003 Golden et al.
6,554,719 B2 4/2003 Peters et al.
6,554,721 B1 4/2003 Woodward et al.
6,558,271 B1 5/2003 Beach et al.
6,592,468 B2 7/2003 Vincent et al.
6,623,378 B2 9/2003 Beach et al.
6,648,772 B2 11/2003 Vincent et al.
6,719,642 B2 4/2004 Wahl et al.
6,719,644 B2 4/2004 Beach
6,739,983 B2 5/2004 Helmstetter et al.
6,773,360 B2 8/2004 Willett et al.
6,800,038 B2 10/2004 Willett et al.
6,811,496 B2 11/2004 Wahl et al.
6,814,673 B2 11/2004 Wahl et al.
6,860,818 B2 3/2005 Mahaffey et al.
6,955,610 B1 10/2005 Czaja et al.
7,147,573 B2 * 12/2006 DiMarco ..... 473/324
7,166,040 B2 * 1/2007 Hoffman et al. ..... 473/334
7,166,041 B2 1/2007 Evans
7,186,190 B1 * 3/2007 Beach et al. ..... 473/335
7,201,669 B2 * 4/2007 Stites et al. ..... 473/337
7,452,286 B2 * 11/2008 Lin et al. ..... 473/334
2003/0232659 A1 12/2003 Mahaffey et al.
2004/0176177 A1 9/2004 Mahaffey et al.
2005/0137024 A1 6/2005 Stites et al.
2005/0227780 A1 10/2005 Cover et al.
2006/0122004 A1 6/2006 Chen et al.
2006/0172821 A1 8/2006 Evans
2006/0178228 A1 8/2006 DiMarco
2006/0240908 A1 * 10/2006 Adams et al. ..... 473/334
2007/0178988 A1 * 8/2007 Tavares et al. ..... 473/334
2007/0225085 A1 9/2007 Koide et al.
2007/0238551 A1 * 10/2007 Yokota ..... 473/349
2008/0020861 A1 * 1/2008 Adams et al. ..... 473/334
2008/0146370 A1 * 6/2008 Beach et al. ..... 473/336
2008/0261715 A1 * 10/2008 Carter ..... 473/291

FOREIGN PATENT DOCUMENTS

JP 1043000278 2/1989
JP 06238022 8/1994
JP 08191907 7/1996
JP 09028844 2/1997
JP 3109501 U 5/2005
WO 2007101350 9/2007

OTHER PUBLICATIONS

European Patent Office Examination Report for EP Application No. 08002354.2 Dated Mar. 5, 2009.

* cited by examiner

GOLF CLUB HEAD AND GOLF CLUB

BACKGROUND OF THE INVENTION

1. Field of the Invention

The invention relates generally to a golf club head and, more particularly, to a wood-type golf club head having an adjustable weight.

2. Description of the Background Art

Current driver and fairway wood golf club heads are typically formed of steel or titanium alloys. For example, oversize driver heads exceeding 300 cc in volume are usually formed of a lightweight titanium alloy such as Ti 6A1-4V. Unless modified, oversize heads can have a relatively high center of gravity, which can adversely affect launch angle and flight trajectory of a golf ball. Thus, many club heads have integral sole weight pads cast into the head at a predetermined location to lower the club's center of gravity. Also, epoxy may be later added through the hosel to obtain a final desired weight of the club head. Alternatively, club heads may have weights, usually of a higher density material than the titanium or steel alloy, externally attached to the sole. The weights may be welded in place or attached using a fastener such as a screw. Because of the repeated contact with the ground during the golfer's swings, use of an adhesive alone is not advised as a long term, external attachment method for a weight.

These weights are of a prescribed amount and are attached prior to purchase. However, the club's weighting typically is set for a standard, or ideal, swing type. Thus, even though the weight may be too light or too heavy, or too far forward or too far rearward, the golfer cannot adjust or customize the club weighting to his or her particular swing.

Previous attempts to solve these issues have resulted in golf club heads with removable weights. For example, U.S. Pat. No. 6,860,818 to Mahaffey et. al discloses a golf club head that includes weights that can be removed from the club head and replaced with heavier or lighter weights depending on the desired configuration of the user. However, the weights shown in Mahaffey are completely removable from the club head by the user and can therefore be easily lost or misplaced by the user.

It should, therefore, be appreciated that there is a need for a golf club head that allows a golfer to fine tune the weight of the club head for his or her swing. The present invention fulfills this need and others.

SUMMARY OF THE INVENTION

Disclosed herein is a golf club head of the wood-type, including: a body defining an interior cavity and including a ball-striking face, a sole, a crown, and a ribbon extending rearwardly from the face; an elongated groove that extends along a portion of the ribbon; a weight slidably disposed in the elongated grove; and a fastener affixed to the weight capable of selectively fixing a location of the weight.

The foregoing and other objects, features, aspects and advantages of the present invention will become more apparent from the following detailed description of the present invention when taken in conjunction with the accompanying drawings.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DESCRIPTION OF THE PREFERRED EMBODIMENTS

Disclosed herein is a golf club head of the wood-type, including: a body defining an interior cavity and including a ball-striking face, a sole, a crown, and a ribbon extending rearwardly from the face; an elongated groove that extends along a portion of the ribbon; a weight slidably disposed in the elongated grove; and a fastener affixed to the weight capable of selectively fixing a location of the weight.

Figure 1:
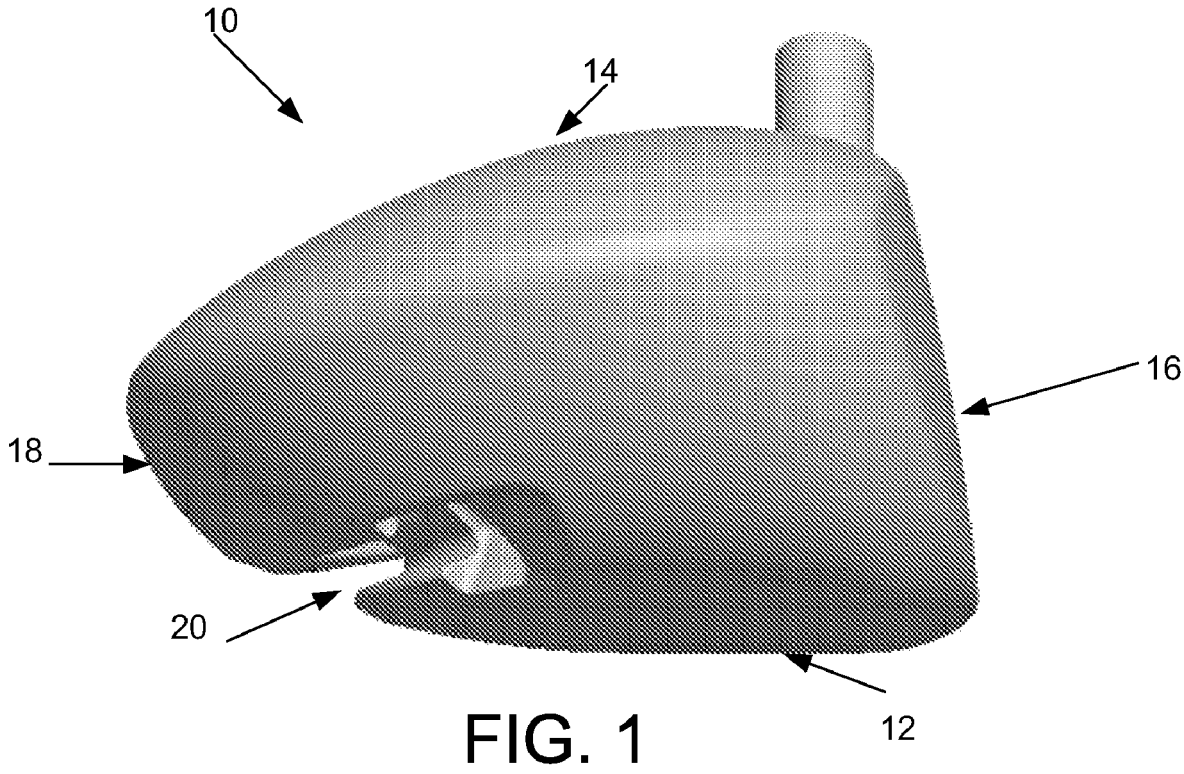
FIG. 1 is a side view of the wood-type golf club head in accordance with an exemplary embodiment.
Figure 2:
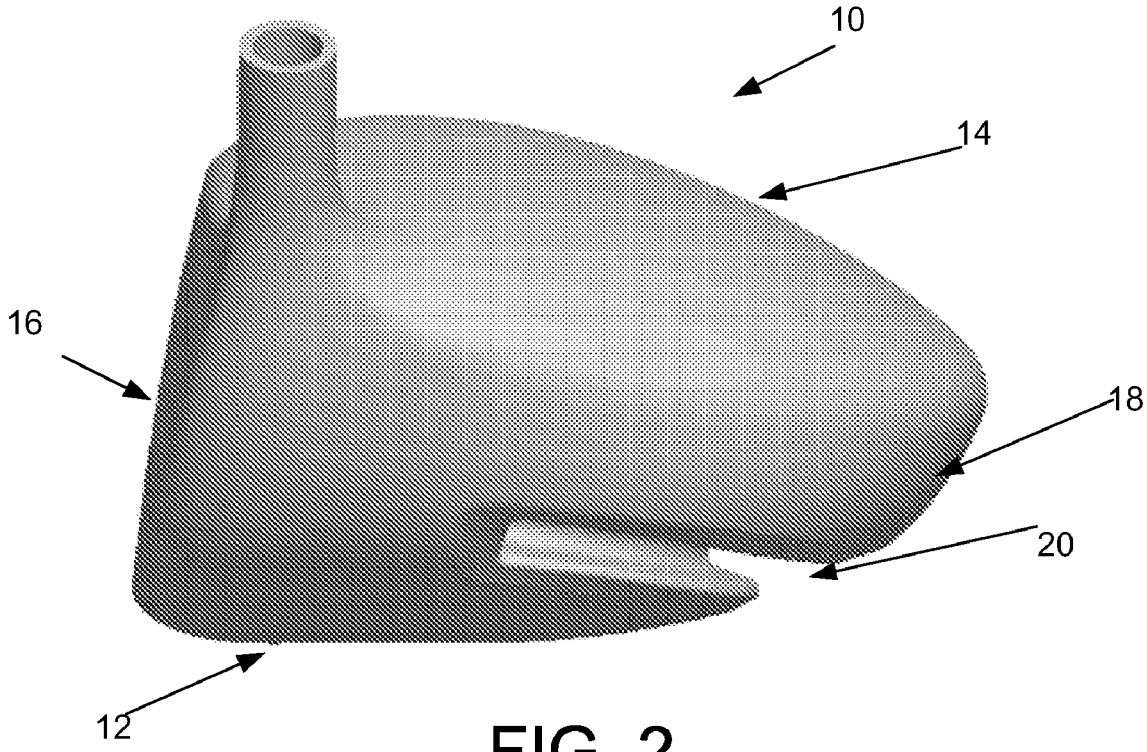
FIG. 2 is another side view of the wood-type golf club head in accordance with an exemplary embodiment.

Referring now to FIGS. 1 and 2, a golf club head 10 in accordance with an exemplary embodiment is illustrated. The club head 10 is of the wood type, and is preferably a metal wood including a body and hosel. In exemplary embodiments, the club head 10 can be formed in a conventional manner, such as welding components together as is known in the art. The club head 10 includes a sole 12, a crown 14, a ball-striking face 16, and a ribbon 18 extending rearwardly from the ball-striking face 16. The ribbon 18 includes an elongated groove 20 that extends along a portion of the ribbon 18. In exemplary embodiments, the elongated groove 20 may be located on a lower portion of the ribbon 18. The elongated groove 20 may extend around the entire ribbon 18, from the heel to the toe of the club head 10, or any portion thereof.

Figure 3:
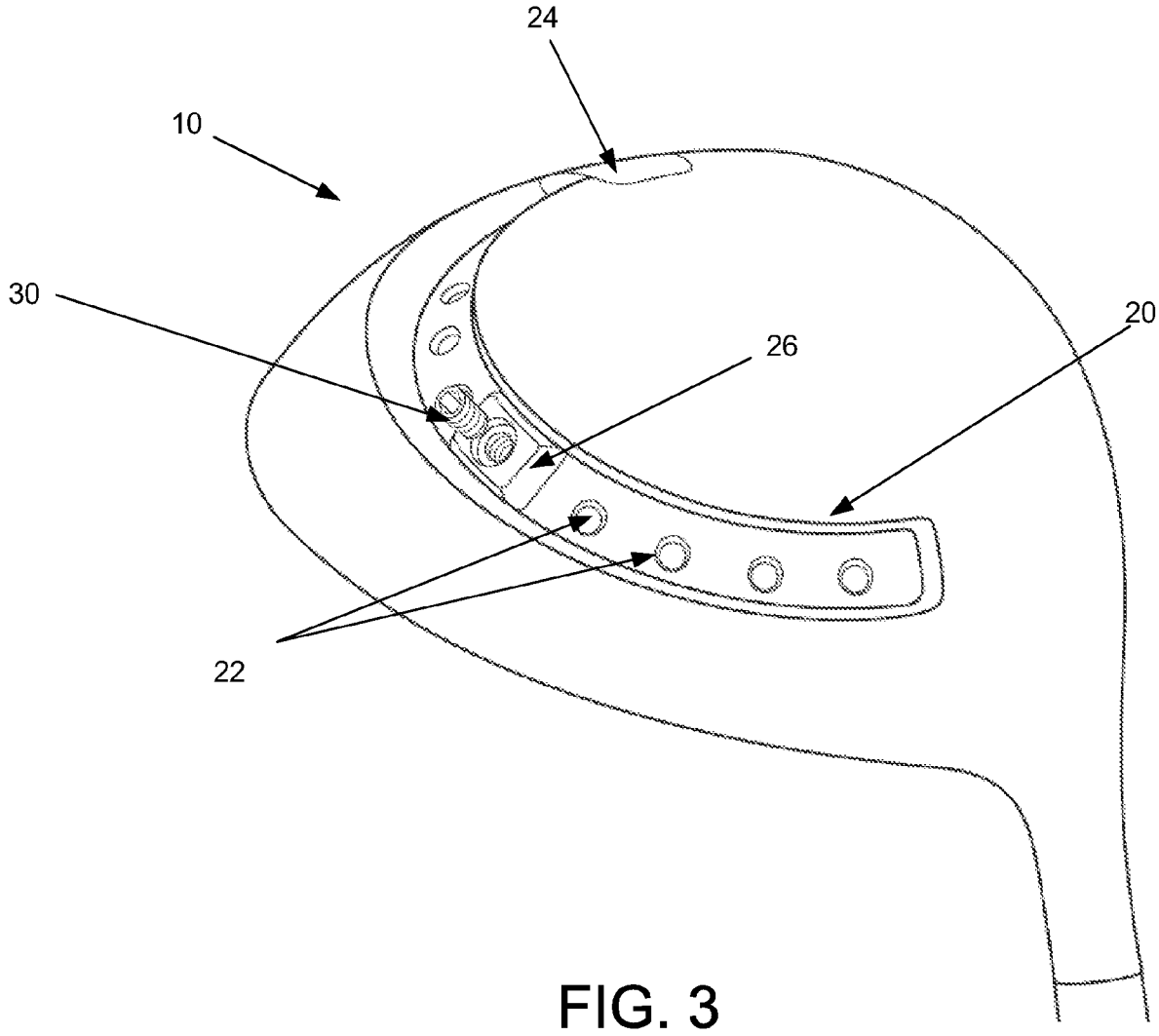
FIG. 3 is a perspective view of the wood-type golf club head in accordance with an exemplary embodiment.

Turning now to FIG. 3, a perspective view of the bottom of the club head 10 is illustrated. As shown, the elongated groove 20 includes a plurality of recesses 22 disposed on an inner surface of the elongated groove 20. The recesses 22 may be of varying width and depth and may be spaced evenly along the elongated groove 20. In an exemplary embodiment, the recess 22 may be sloped on both sides to guide the weight to a predetermined position in the elongated groove 20. A receiving slot 24 is located adjacent to one end of the elongated groove 20 and the receiving slot 24 has an aperture larger than the outer portion of the elongated groove 20. The elongated groove 20 is designed to house one or more weights 26 that can be repositioned by a user. The number of weighs 26 in the elongated groove 20 is less than the number of recess 22 disposed along the inner portion of the elongated groove 20. In one embodiment, the weights 26 are inserted into the elongated groove 20 through the receiving slot 24 by the manufacture of the club such that the weights are not removable from the elongated groove 20.

Continuing with reference to FIG. 3, the weight 26 is slidably disposed in the elongated groove 20. In addition, the receiving slot 24 includes a stop that is positioned in the receiving slot 24 to prevent the weight 26 from being removed from the elongated groove 20. The weight 26 includes a fastener 30 that is designed to selectively fix the position of the weight 26 in the elongated groove. In an exemplary embodiment, the fastener 30 is a bolt that extends through the weight 26 and engages one of the recesses 22 on the inner surface of the elongated groove 20. The fastener 30 is designed to prevent the weight 26 from moving in the elongated groove 20 during the swinging of the golf club during which the weight 26 can be subjected to several strong forces.

In exemplary embodiments, the club head 10 may include a plurality of weights 26 that are slidably disposed in the elongated groove 20. The weights 26 are inserted into the elongated groove 20 through the receiving slot 24 and a stop is placed in the receiving slot 24 to prevent the weights 26 from being removed from the elongated groove 20. The weights 26 can be placed in a uniform weight distribution pattern in the elongated groove 20 or in a variable distribution so that more weight can be provided in a particular region of the club head 10, either rearwardly or more toward the toe or heel portion as desired. In exemplary embodiments, the weight 16 can be formed of any material such as metal or fiber reinforced plastic.

Figure 4:
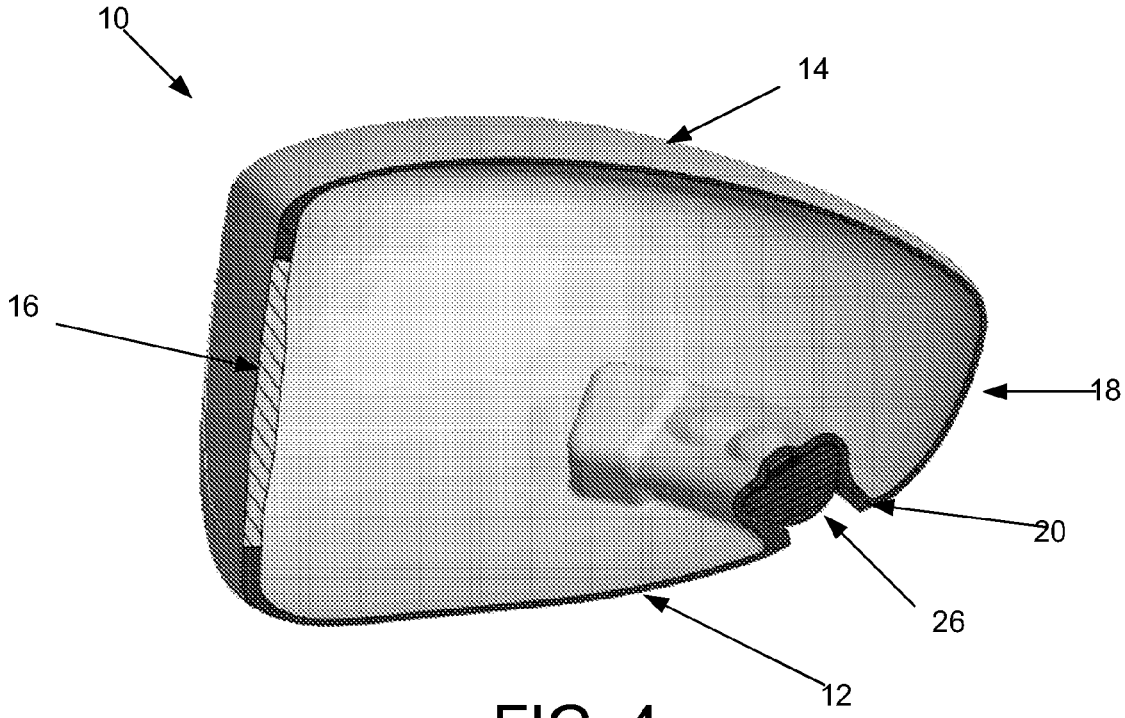
FIG. 4 is a cross-sectional view of the wood-type golf club head in accordance with an exemplary embodiment.
Figure 5:
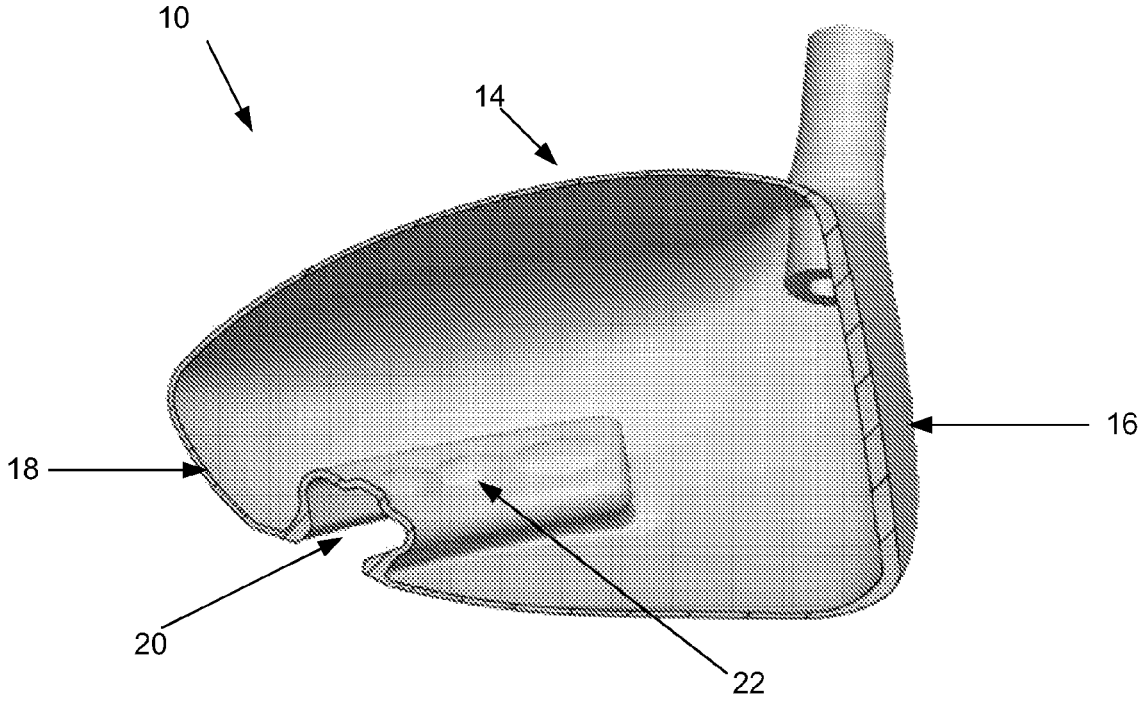
FIG. 5 is another cross-sectional view of the wood-type golf club head in accordance with an exemplary embodiment.

Turning now to FIGS. 4 and 5, cross sectional views of the club head 10 are illustrated. As shown, the elongated groove 20 may have a dovetail shape that is designed to allow the weights 26 to freely slide in the elongated groove 20 but prevent the weights 26 from coming out of the elongated groove 20. In other exemplary embodiments, the elongated grove 20 may have another suitable shape. The weights 26 may have a shape designed to be at least partially complementary to the shape of the elongated groove 20. Additionally, the one or more weights 26 may all have the same mass or different masses. For example, three weights 26 may be disposed in the elongated groove 26 and the outer two weights may have the same mass while the central weight has a different mass.

By changing the location of the weights 26 in the elongated groove 20 the user can effectively change the performance of the club head 10. For example, an increased weight at the bottom of the head provides a higher trajectory to a ball struck by the club. Peripheral weighting increases the moment of inertia and the resistance to rotation of the club, particularly when a ball is struck outside the center of the striking face.

Figure 6:
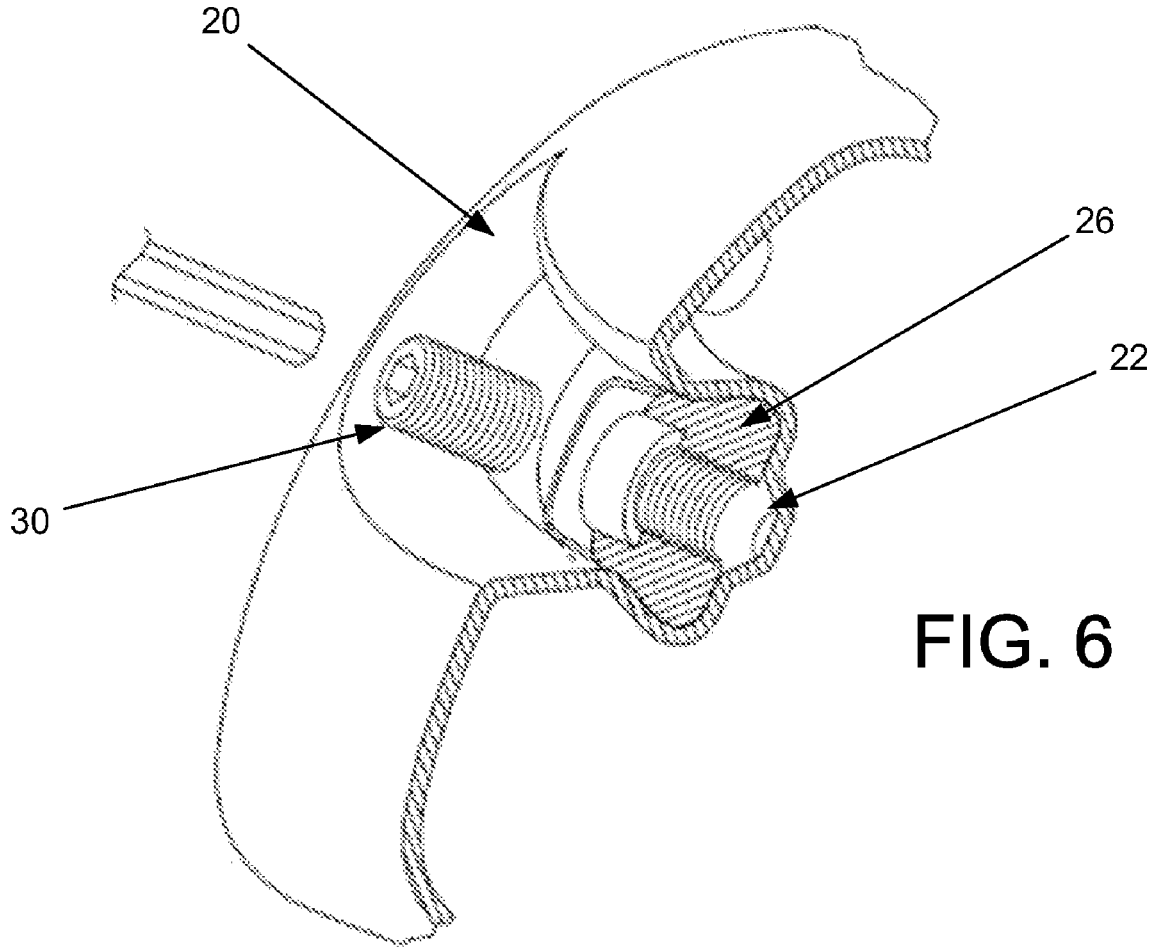
FIG. 6 is a cross sectional view of a portion of the wood-type club head in accordance with an exemplary embodiment.
Figure 7:
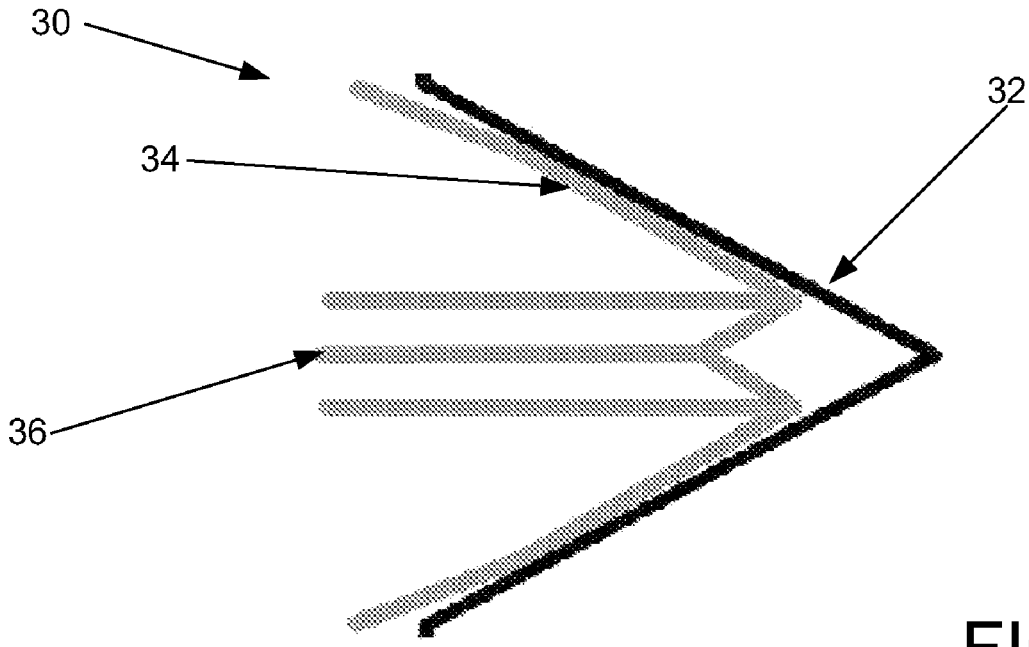
FIG. 7 is a cross sectional view of a spring bolt in accordance with an exemplary embodiment.

Referring now to FIGS. 6 and 7 a cross sectional view of a portion of the wood-type golf club head 10 and the fastener 30 are show, respectively. The fastener 30 is designed to affix the location of the weight 26 in the elongated groove 20 by engaging both the weight 26 and the recess 22. In one embodiment, the fastener 30 may be a threaded bolt 30 which extends through the weight 26 and contacts the recess 22. In another exemplary embodiment, the fastener 30 may be a spring bolt, a cross section of a portion of which is illustrated in FIG. 7. The spring bolt 30 includes a compression portion 36 disposed in the center of a thread portion 34 of the spring bolt. The thread portion 34 is designed to compress when in contact with a receiving member 32 and thereby prevent the spring bolt 30 from turning freely in the weight 26.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A golf club head of the wood-type, comprising:

a body defining an interior cavity and including a ball-striking face, a sole, a crown, and a ribbon extending rearwardly from the face;

an elongated groove that extends along a portion of the ribbon, the elongated groove defining an aperture opening to receive a stop;

one or more weights slidably disposed in the elongated groove, the one or more weights being sized and shaped to slide in the groove to enable the one or more weights to slide in the groove around the ribbon and wherein the stop is positioned in the groove to prevent the one or more weights from leaving the groove; and a fastener affixed to the one or more weights capable of selectively fixing a location of the one or more weights, wherein the elongated groove includes a plurality of recesses disposed on an inner surface operable to receive the fastener.

2. The golf club head of claim 1, wherein a number of weights slidably disposed in the elongated groove is less that a number of recesses disposed on the inner surface of elongated groove.

3. The golf club head of claim 2, wherein the fastener is a spring bolt that extends through the weight and contacts one of the plurality of recesses disposed on the inner surface of the elongated groove.

4. The golf club head of claim 1, wherein the elongated groove has a dovetail shape and the weights have a complementary shape.

5. The golf club head of claim 1, further comprising a receiving slot operable to receive the weight and insert the weight into the elongated groove, the receiving slot being located at one end of the elongated groove.

6. The golf club head of claim 1, wherein each of the plurality of recesses disposed in the groove and located on the groove inner surface each comprise opposing sloped walls being shaped to extend rearwardly away from each other.

7. A golf club head of the wood-type, comprising:

a body defining an interior cavity and including a ball-striking face, a sole, a crown, and a ribbon extending rearwardly from the face;

an elongated groove that extends along a lower portion of the ribbon including a plurality of recesses disposed on an inner surface of the elongated groove, wherein the groove is uninterrupted and defines an aperture to receive a stop;

a plurality of weights slidably disposed in the elongated grove, the weights being sized and shaped to slide in the groove and wherein the stop is positioned in the groove to prevent the weights from exiting the groove; and a fastener affixed to each of the plurality of weights capable of selectively fixing a location of the weights corresponding to one of the recesses.

8. The golf club head of claim 7, wherein a number of weights is less than a number of recesses.

9. The golf club head of claim 8, wherein the fastener is a spring bolt that extends through the weight and contacts one of the plurality of recesses disposed on the inner surface of the elongated groove.

10. The golf club head of claim 7, wherein the elongated groove has a dovetail shape and the weights have a complementary shape.

11. The golf club head of claim 7, wherein the aperture is located at one end of the elongated groove and is configured to receive the weights and hold the stop.

12. The golf club head of claim 11, further comprising a stop disposed in the receiving slot that prevents the weight from leaving the elongated groove.

13. In a golf club head having a body defining a ball-striking face, a sole, a crown, and a ribbon portion, an adjustable weight golf club system configured to enable a user to adjust the position of one or more weights disposed proximate the ribbon portion to adjust mass properties of the golf club, the adjustable weight golf club system comprising:

a groove generally positioned proximate a ribbon portion of a golf club and extending along at least a portion of the ribbon;

the groove comprising opposed groove walls and a groove inner surface, the groove walls configured to extend from the groove inner surface to define a groove opening;

a plurality of recesses disposed in the groove and located on the groove inner surface, each of the recesses comprising opposing sloped walls being shaped to extend rearwardly away from each other; and at least one weight configured for placement within the groove and configured to be slidably disposed within the groove, the at least one weight further configured to be releasably lockable with the plurality of recesses so that the at least one weight can be moved along the groove and selectively affixed at a predetermined one of the recesses.

14. The adjustable weight golf club system of claim 13, the plurality of recesses each comprising a middle section disposed generally between the opposing sloped walls, wherein the opposing sloped walls are configured to position the at least one weight to a predetermined position in the elongated groove.

15. The adjustable weight golf club system of claim 13, wherein the plurality of recesses are spaced evenly along the groove inner surface and configured to position the at least one weight at a predetermined position in the elongated groove.

16. The adjustable weight golf club system of claim 13, further comprising a curved groove track positioned between the groove inner surface and one of the groove walls, the curved groove track configured to receive a corresponding curved portion of the at least one weight.

17. The adjustable weight golf club system of claim 13, the opposed groove walls further configured to extend toward each other to define a groove cavity opening, the groove cavity opening extending substantially along the length of the groove.

18. The adjustable weight golf club system of claim 17, wherein the at least one weight has a top surface and configured to be situated to fit within the groove to allow the top surface of the weight to be below a plane defined by the groove cavity opening.

19. The adjustable weight golf club system of claim 13, wherein the at least one weight is sized and shaped to have a complimentary cross section as the dovetail-shaped groove, the at least one weight having opposed ends extending toward the opposed groove walls to snugly fit within the groove.

20. The adjustable weight golf club system of claim 13, further comprising a weight entry slot configured to allow for entry of the at least one weight into the groove.

* * * * *